US006135215A

United States Patent [19]

Ericksen

[11] Patent Number: 6,135,215

[45] Date of Patent: Oct. 24, 2000

[54] TOOL STRING APPARATUS FOR LATERAL BOREHOLE FORMATION

[76] Inventor: William R. Ericksen, P.O. Box 1109, Hobbs, N. Mex. 88240

[21] Appl. No.: 09/291,405

[22] Filed: Apr. 13, 1999

Related U.S. Application Data

[60] Provisional application No. 60/081,607, Apr. 14, 1998.

[51] Int. Cl.[7] ..... E21B 7/04

[52] U.S. Cl. ..... 175/61; 175/62; 175/73; 175/90

[58] Field of Search ..... 175/61, 62, 73, 175/90, 162, 323

[56] References Cited

U.S. PATENT DOCUMENTS 4,226,288 10/1980 Collins ..... 175/62
4,501,337 2/1985 Dickinson et al. ..... 175/61 X

*Primary Examiner*—Roger Schoeppel

[57] ABSTRACT

Apparatus for curving a vertical borehole laterally towards the horizontal by anchoring a diverter downhole in the bore-hole near the formation to be produced. A special cantaloupe shaped drilling mill is attached to the end of a rigid drill string to form an opening through the casing wall in proximity of the formation to be produced. Then a special concave cutting device enlarges the opening into a window of a size to accommodate a flexible drill string that subsequently is attached to the rigid drill string. A bit attached to the flexible drill string is extended through the window where it drills a curved borehole towards the horizontal and continues laterally through the formation. The flexible drill string has a central fluid passageway and is formed of resilient material which surrounds an inner spring member to form a flexible, longitudinally extending, torque transferring drilling string. The opposed ends of the spring member each abutt a coupling member which enables the flexible tool string to be connected into any drill string. The spring is tight wrapped and transmits torque produced by the rig into a drill bit.

11 Claims, 4 Drawing Sheets

FIG. 1
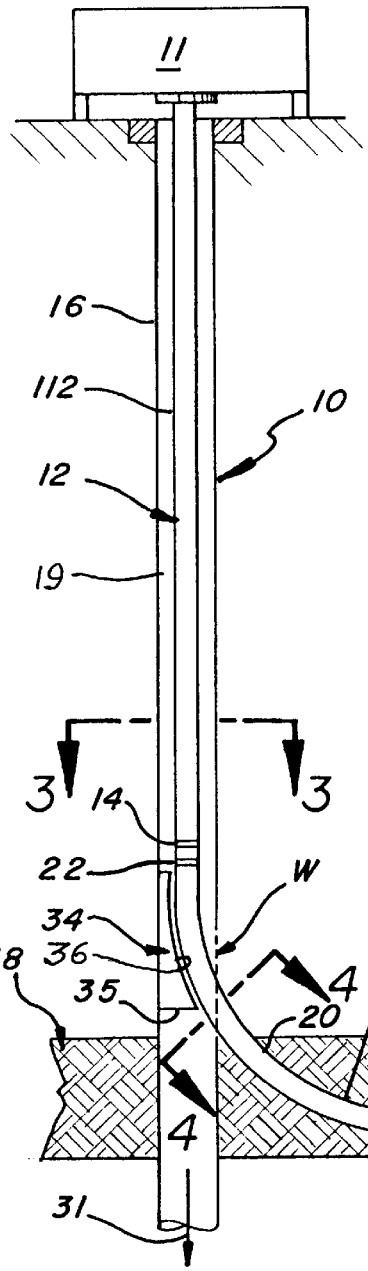
FIG. 2
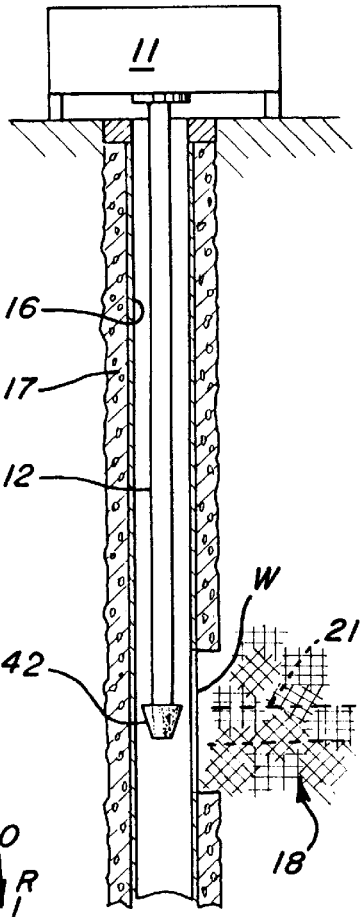
FIG. 5
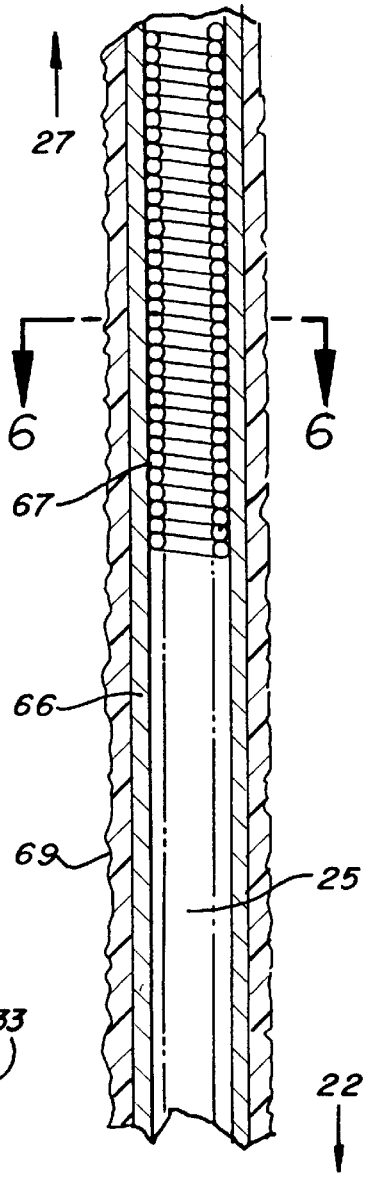
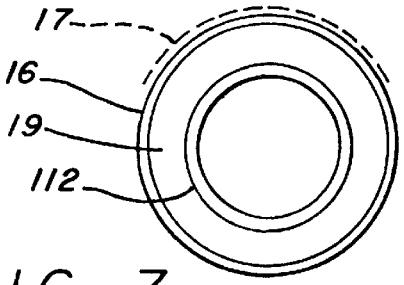
FIG. 3
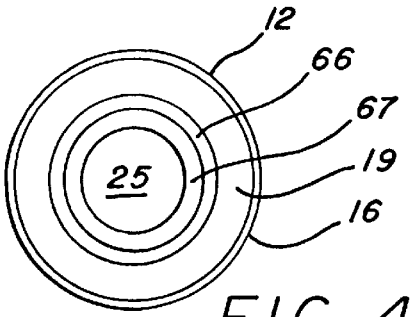
FIG. 4

FIG. 8
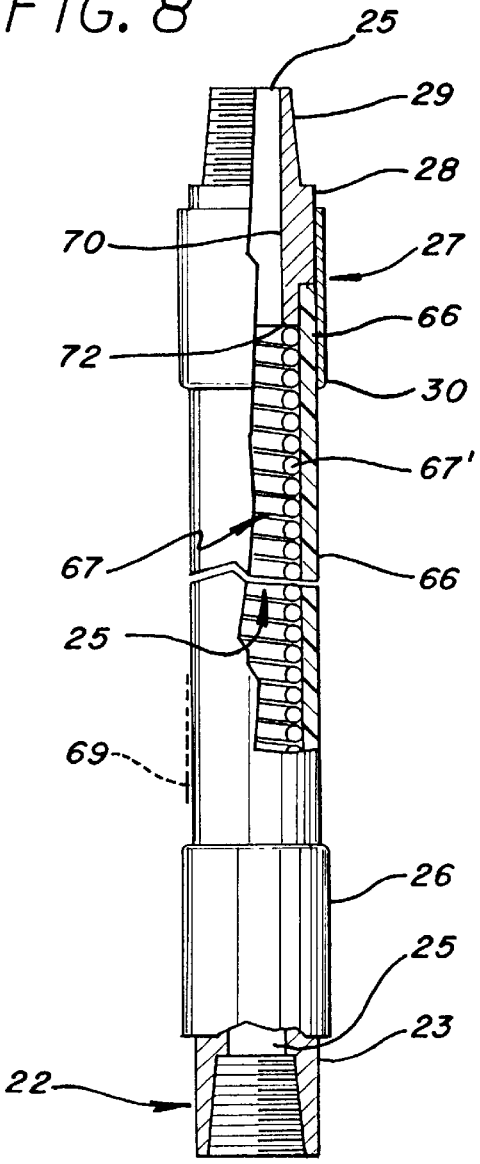
FIG. 9
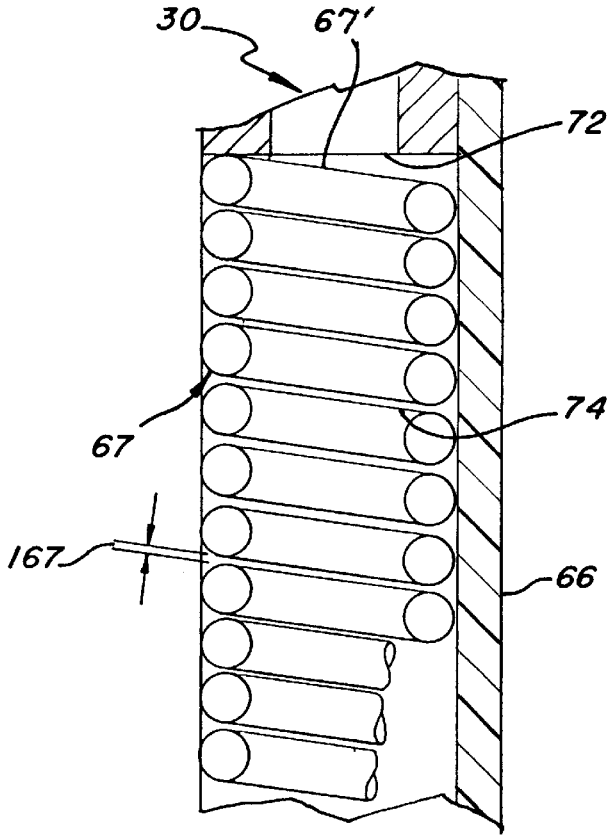
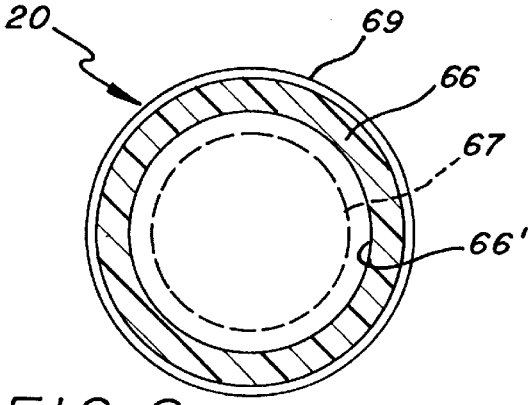
FIG. 6
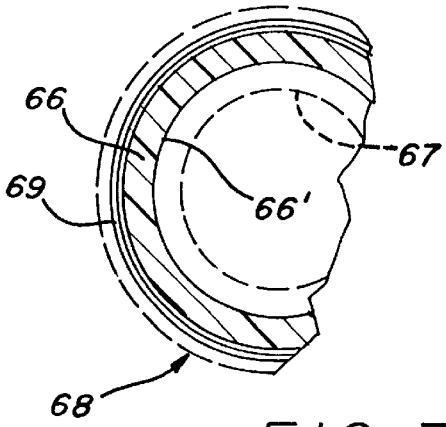
FIG. 7

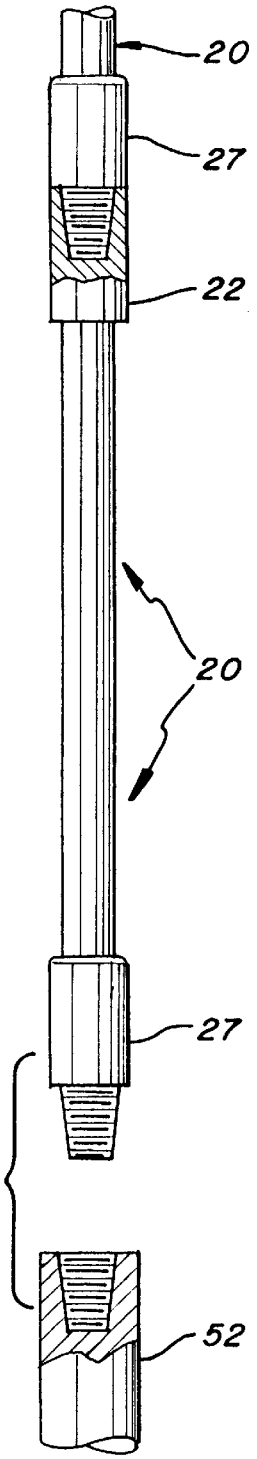
FIG. 10
FIG. 11
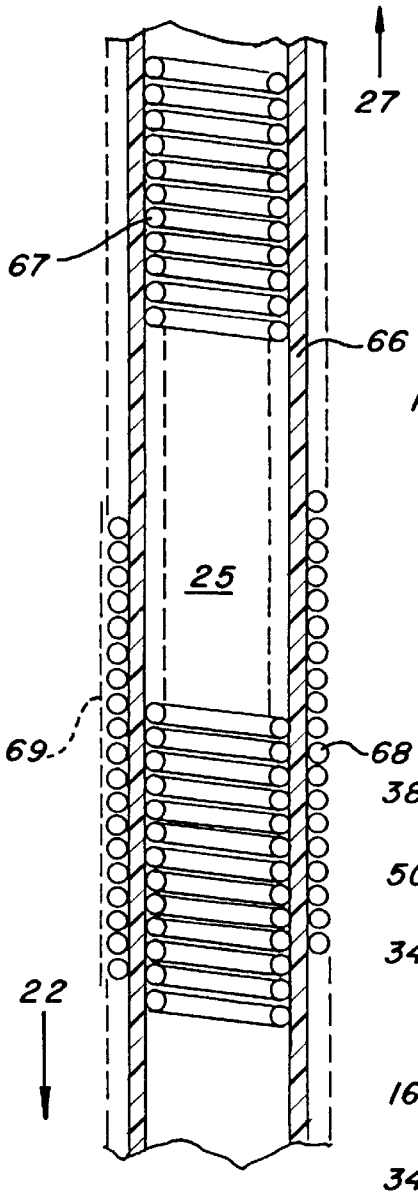
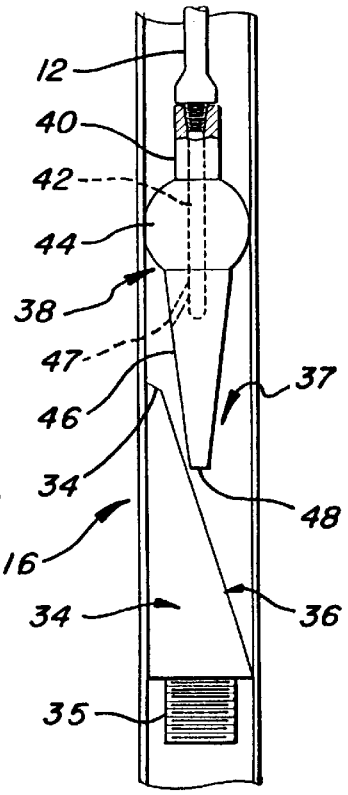
FIG. 12
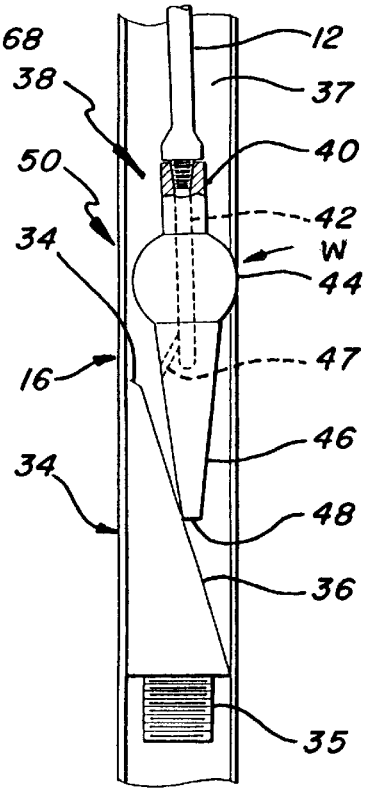
FIG. 13

FIG. 14
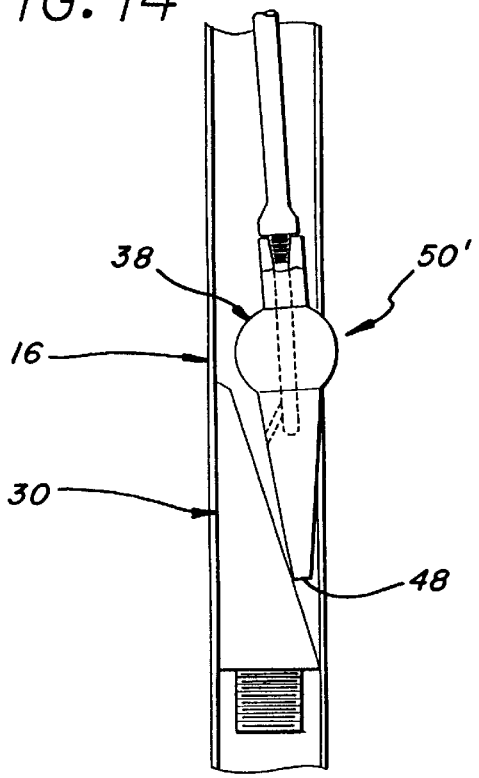
FIG. 15
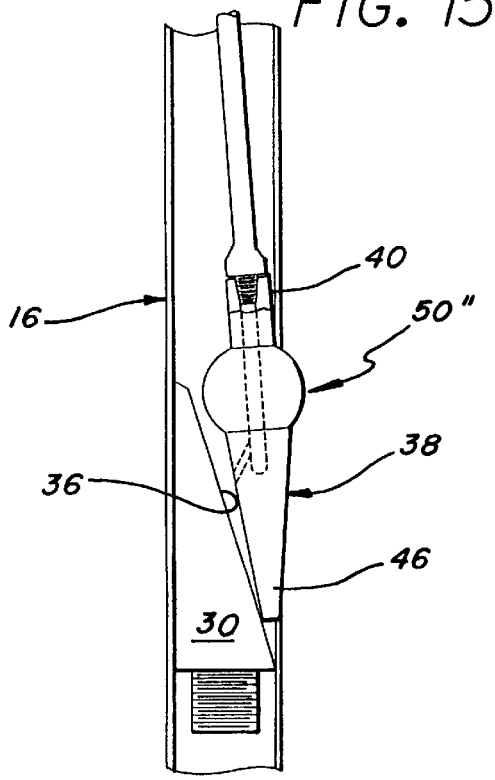
FIG. 17
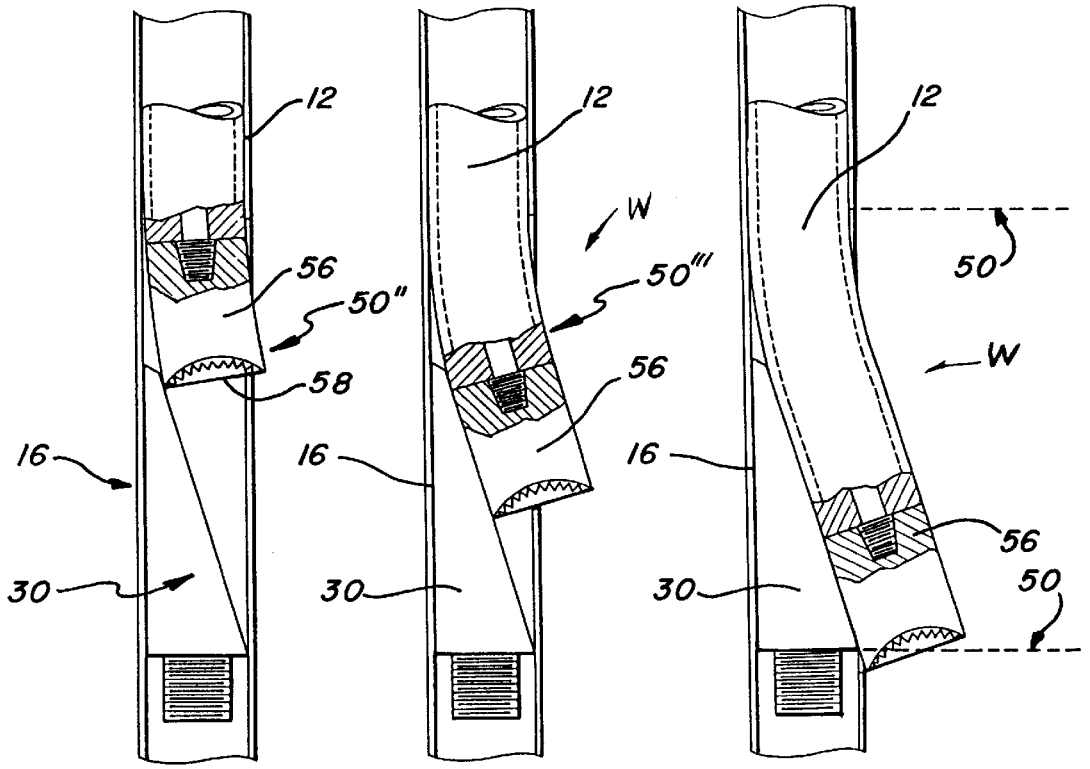
FIG. 16
FIG. 18

TOOL STRING APPARATUS FOR LATERAL BOREHOLE FORMATION

REFERENCE TO PRIOR APPLICATIONS

My previously filed "Provisional Patent Application" for "Tool String Apparatus for Lateral Borehole Formation", Ser. No. 60/081,607, Filed Apr. 14, 1998.

REFERENCE TO THE PRIOR ART

Reference is made to my prior Patent, Seabourn et al, Pat. No. 5,085,283, issued Feb. 4, 1992, for "Method and Tool String for Curving A Vertical Borehole Horizontally", and the art cited therein.

BACKGROUND OF THE INVENTION

It is known to drill horizontally through a pay zone to expose large areas of the production formation to a vertical wellbore and thereby increase the production rate of the well. A vertical borehole can be slanted towards the horizontal by using a whip-stock in order to offset the well using a conventional drill string; however, it is difficult to enter a thin hydrocarbon bearing formation using this technique alone. Drilling a lateral from a vertical borehole at a precise location that assures the lateral penetrating the production formation is the subject of this disclosure.

After a well has been geologized, and the payzone precisely located, a lateral borehole that extends from the vertical at the precise location required to intercept and penetrate the payzone is more likely to be made possible if an unusually small radius of curvature can be effected into the drill string extending from the casing. When this radius of curvature is known, the location of the lateral can be predicted accurately.

Method and apparatus for achieving the above desirable goals is possible by the provision of a flexible drill string that does not require a downhole motor driven bit; that can make a sharp bend to turn the vertical borehole laterally and thereafter continue to drill horizontally while being rotated by a rotary turn table of an ordinary drilling rig; and such a method and apparatus is the subject of the present invention.

SUMMARY OF THE INVENTION

The present invention provides a flexible drill string apparatus for curving a vertical borehole laterally towards the horizontal, so that a production zone can be accurately intercepted by a drill bit, thereby forming a borehole having a vertical length that extends down into the earth and then abruptly deviates from the vertical and curves towards the horizontal. The apparatus comprises an elongated flexible rotatable tool string that can be made to conform to a segment of a small radius curve while being rotated.

The flexible drilling string has a central fluid conveying passageway, preferably a resilient tubing made of a flexible material that forms a housing and surrounds an internal fully compressible coiled spring. The spring defines the central fluid passageway and forms a power transfer means by which a drill bit is rotated as it is advanced into a formation while making hole. The tubing that forms the central passageway is a reinforced elastomeric conduit. The coiled spring is circumferentially arranged about the interior of the elastomeric conduit and is connected to form a novel unitary bendable power transmitting flow conduit.

The flexible drill string is made of at least one section, and can be made into a plurality of series connected sections, with each section having a common longitudinal central axis that can be deformed into a curve. Each section has connector devices at opposed ends thereof and can be attached to an adjacent section such that the drill string can be of a suitable length to be deformed into a segment of a circle of a selected diameter and thereby achieve the purpose of guiding and rotating a bit located at the lower terminal end thereof to form a horizontally disposed lateral borehole connected to a vertically disposed borehole.

A novel method of gaining access to the surrounding formation is provided by apparatus for cutting a window into the casing. The apparatus includes a casing cutter device comprising a boring device that is manipulated by a conventional drill rig and string in order to make a first opening through the casing side-wall in proximity of the payzone. This is followed by a second boring device that also is manipulated by the conventional drill rig and string in order to enlarge the first opening through the casing sidewall to a predetermined configuration by which the before mentioned flexible drill string is introduced into the formation.

Thereafter the flexible drill string is attached to the lower end of the drill string of the conventional drill rig. Then a bit is attached to the flexible string and extended through the enlarged window of the casing sidewall out into the payzone as the borehole is curved from vertical into the horizontal and extended laterally out into the payzone.

Accordingly, a primary object of the present invention is the provision of method and apparatus by which a lateral bore-hole can be connected to a vertical borehole with a short radius of curvature therebetween.

Another object of the present invention is the provision of a relatively flexible drill string for drilling a lateral part of a borehole from a vertical part of a borehole, in combination with apparatus for gaining access through a casing into the surrounding formation. This is provided by apparatus for cutting a window into the casing. The apparatus includes a casing cutter device comprising a boring device that is manipulated by a conventional drill rig and string in order to make a first opening through the casing sidewall into the payzone.

This action is followed by a second boring device that also is manipulated by the conventional drill rig and string in order to enlarge the first opening through the casing sidewall to a predetermined configuration which admits the flexible drill string and drill bit therethrough.

A still further object of this invention is the provision of a flexible drill string having an axial passageway formed within an axially arranged elongated tight wrapped spiral spring member connected to transmit torque while guiding a drill bit to thereby form a lateral borehole connected to a vertical borehole.

Another and still further object of this invention is the provision of a flexible drill string that does not require a downhole motor for driving the bit; the flexible drill string being a longitudinally extending, circumferentially arranged reinforced member associated with an axially arranged elongated tight wrapped spiral spring member connected to transmit torque while guiding a drill bit to thereby form a lateral borehole connected to a vertical borehole; and having opposed ends that abuttingly engages the connectors by which it can be connected into a tool string and thereby drill a borehole having a sharp bend where it diverges from the vertical into the horizontal.

Still another and further object of this invention is the provision of a flexible drill string having opposed ends attached to connectors by which the string can be connected into a tool string which can drill while turning the borehole laterally and thereafter continue to drill while being rotated by a rotary turn table of a drilling rig; and thereby form a sharp bend in the borehole.

These and other objects and advantages of the present invention will become readily apparent to those skilled in the art upon reading the following detailed description and claims and by referring to the accompanying drawings.

The above objects are attained in accordance with the present invention by the provision of both method for use with apparatus fabricated in a manner substantially as described herein.

BRIEF DESCRIPTION OF THE DRAWINGS

FIG. 1 is a part diagrammatical, part schematical, part cross-sectional view showing a wellbore that has been formed according to the method of this invention and having apparatus made in accordance with the present invention associated therewith;

FIG. 2 is a part diagrammatical, part schematical, part cross-sectional view showing a wellbore that is being formed according to the method of this invention and having apparatus made in accordance with the present invention associated therewith;

FIG. 3 is an enlarged, fragmentary cross-sectional view taken along lines 3—3 of FIG. 1;

FIG. 4 is a cross-sectional view taken along lines 4—4 of FIG. 1;

FIG. 5 is an enlarged, fragmentary, longitudinal part cross-sectional, side view of some of the apparatus disclosed in FIG. 1;

FIG. 6 is an enlarged, fragmentary cross-sectional view taken along lines 6—6 of FIG. 5;

FIG. 7 is similar to FIG. 6 and sets forth a modification thereof;

FIG. 8 is a diagrammatical, part cross-sectional, representation of a side elevational view of a preferred embodiment of the present invention, with some parts thereof being broken away and shown in cross-section to better disclose some of the details thereof;

FIG. 9 is an enlarged, fragmentary, cross-sectional view showing additional details of FIG. 8;

FIG. 10 is a diagrammatical, part cross-sectional, representation of a side elevational view of a preferred embodiment of the present invention, in combination with other apparatus, with some parts thereof being broken away and shown in cross-section to better disclose some of the details thereof;

FIG. 11 is an enlarged, part diagrammatical, part cross-sectional representation of still another embodiment of the present invention, with some parts being broken away to disclose some additional details thereof;

FIG. 12 is an enlarged, fragmentary, part cross-sectional, side view showing additional details of the apparatus for forming the window W disclosed in FIG. 2, FIGS. 13, 14, and 15 are similar to FIG. 12 and disclose the apparatus thereof in various different operational configurations;

FIGS. 16, 17, and 18 are similar to FIGS. 12–15 and disclose additional apparatus for completing the window W of FIG. 2.

DETAILED DESCRIPTION OF THE PREFERRED EMBODIMENTS

In the Figures of the drawings, and particularly FIG. 1, there is disclosed both method and apparatus for forming a borehole 10 in accordance with the present invention. A drilling rig 11 has the usual derrick and turn table for manipulating a drill string 12.

FIG. 2 illustrates a borehole having a cemented casing through which a window has been formed in accordance with this invention.

FIG. 1 illustrates a crooked borehole 10 within which there is rotatably disposed a drill string 12 having a vertical upper length 112 and a lower lateral length 212 connected in communication therewith by means of the illustrated curved interconnecting flexible part 20 of the drill string 12 and which is a segment of a circle as indicated by radius R. The upper length of the borehole is cased in the usual manner as seen at 16 and 17. The lower lateral length at 21 can extend from the vertical length 112 at any desired angle respective to the horizontal, and preferably is horizontally disposed as indicated.

An upper rigid casing 16, of prior art design, is located in the vertical part of the borehole 10 and extends downhole adjacent to the curved part R of the borehole where it usually terminates at 31 below a hydrocarbon producing formation 18. It is desired to produce the formation 18 from the lateral part 21 thereof using techniques in accordance with this disclosure. As previously seen in FIG. 2, the sidewall of casing 16 must therefore be penetrated in order to provide a window W through which the curved tool string 20 of this disclosure can be extended into the surrounding formation 18, with the tool string being rotated by the drilling rig 11 as it is forced to move along the indicated curved path R (FIG. 1) as the curved part of the borehole is formed. Then the borehole is extended further along a horizontal path as the lateral part 21 of the borehole is formed by the novel techniques set forth in this disclosure, and which can be employed by the operators of the drilling rig 11, as will be more fully appreciated later on herein.

The relatively rigid upper drill string 112 of FIG. 1, which can take on any number of different forms, is positioned within cemented casing 16 in the usual manner and can be manipulated by any suitable drilling apparatus associated with the drilling rig 11. The rigid upper drill string 112 extends down the vertical length of the borehole adjacent to the curved part R where the lower end thereof is seen to be attached at sub 14 to the upper end 22 of the flexible or lower drill string 20, made in accordance with this invention. An opposed end 24 of the flexible drill string 20 is attached to the upper end of any number of different drilling or boring bit apparatus 33. The length of the flexible string 20 should be about 15 to 30 feet in order to make a 90 degree turn and additional sections 20 can be series connected as may be desired to provide for having a remaining length for boring a sufficient horizontal distance from the vertical borehole.

In FIGS. 1, 12–17 and 18 a diverter 34 is of any known means for diverting a drill bit to form an angle of the hole from vertical towards the horizontal. Such an apparatus is usually referred to as a whipstock; and, U.S. Pat. No. 2,726,847 to McCune et al and 3,398,804 to Holbert are examples. Further examples are mentioned in my previous U.S. Pat. No. 5,085,285. The diverter is anchored downhole by a number of different means, such as, for example, placing the lower end 35 of the diverter 34 on the end of a joint of tubing string, and cementing it into proper oriented position such that the upper end is positioned to enable curved face 36 to subsequently engage and guide a first part of a window forming device 38 into proper cutting engagement with respect to a selected area of the interior surface of the casing sidewall.

FIGS. 12–15 illustrate the first part of the window forming device or tool 38, made in accordance with this invention, and hereinafter referred to as a cantaloupe mill. The cantaloupe mill 38 is attached to the lower terminal end of a standard drill string 112 for rotation and manipulation thereof. The upper end of the drill string 112 is connected to the kelly of the drilling rig 11 of FIG. 1. Annulus 37 is formed between casing 16 and the cantaloupe mill 42.

In FIGS. 12–15, the cantaloupe mill device 38 has a shank 40 which serves to connect the mill device 38 to the string 12. The shank diverges into a globe 44 which resembles a Pecos Cantaloupe, and then tapers to lower terminal end 46. The lower end below the cantaloupe is a frustum of a cone having an outer surface designed to bear against guide surface 36 of the diverter 30 with low friction. Fluid passageways 42, 47 deliver drilling fluid to facilitate the initial stage of the window cutting operation that penetrates the casing 16 at W.

FIGS. 1, 4, 5 and 6, together with other figures of the drawings, disclose a cross-sectional representation of the preferred embodiment of the flexible drill string 20 of this invention. As particularly seen illustrated in FIGS. 4–6, 8–10 and 20, an axial fluid flow passageway 25 extends longitudinally through the string through which fluid can flow from the surface down to the bit face and back up through annulus 37, to the surface of the ground; or vise versa.

In FIGS. 16–18, and in particular, FIG. 18, there is disclosed a cutter device 56 having an upper end 60 attached to the relatively inflexible upper drill string 12 for enlarging the opening 50 (FIG. 13) previously formed by the mill 38. An axial passageway 62 conducts fluid from string 12 to a circular cutting face 58. The cutting face 58 defines the concave cutting surface of the tool 56 which rotatably engages casing 16 and extends the initial opening 50 in a downhole direction so that the length of window W has a depth which admits a subsequently employed drill bit 33 therethrough. Accordingly, it will be seen that the first window forming tool is the milling tool 38 that initially forms the opening of the side wall of the casing, and the second window forming tool is the cutting tool 56 that engages the casing wall and cuts an elongated slot which extends the initial opening into a configuration that allows the flexible drill string 20 and bit 33 to penetrate formation 18 with a radius of curvature R and thereby form the lateral borehole 21.

In FIGS. 4–6, 8 and 9, the flexible drill string 20 is seen to have a flexible reinforced elastomeric flow conduit 66 of commercial design adapted to withstand considerable internal pressure, such as, for example, a heavy duty hose reinforced with several plies of fabric material. Within the conduit 66 is tight wrapped inner spring 67 which can be fully collapsed, that is, when the spring is twisted or torqued during transmission of relatively low torsional forces, each of the adjacent spirals will touch one another while protecting the conduit 66 from collapsing. Further torque applied thereto enables the inner spring to transmit rotational force in a bit 33 located downhole thereof without further deformation of conduit 66 which therefore is protected from collapsing. The spring extends about the interior surface of conduit 40 and preferably is placed closely adjacent to the conduit 66 and with each of the opposed ends of the conduit being attached to the opposed connectors 22 and 27.

An outermost coating 69 is applied to the outer surface of the conduit 66 as seen at 69 thereby forming a flexible indestructible outer housing for use as part of the flexible drill string 20. Thus, the spring member 67 is captured within the conduit and thereby restrains the conduit of the flexible string 20 from internal buckling.

The drilling rig 11 manipulates and rotates the upper rigid string 12, which motion is transmitted to the bit 33 by means of the lower flexible string 20, made in accordance with this invention. The lower flexible string 20 can negotiate an unusually sharp curve of very small radius R.

In FIGS. 4–6, together with other figures of the drawings, the longitudinally extending, circumferentially arranged, spiraling spring member 67 is seen to be closely adjacent to the interior of the elastomeric inner conduit 66, and it is deemed to be within the comprehension of this disclosure for the spring and conduit to be vulcanized together by a suitable elastomer, with the elastomer preferably being extruded into the openings between the spirals of the spring member and thereby resiliently anchoring the spirals thereof to the conduit and thereby forming the interior wall surface of the flexible string for formation of the axial flow passageway 25.

FIGS. 5–10 show a section of the borehole at a down-hole elevation that penetrates the desired payzone. The string 20 can be of any desired length, and the spaces between adjacent spirals of the elongated spring member 72 is shown in a reduced torqued or dynamic configuration in FIG. 9 at 167. The space 167 is reduced, as may be expected, while drilling with the bit 28 under a load while making hole. This is the fully col- lapsed configuration.

As best seen in FIGS. 7 and 11, the opposed ends 22, 27 of the flexible drill string 20 is provided with an upper connector 22 (box end of the flexible string) and a lower connector 27 (pin end of the flexible string), respectively, at opposed ends, respectively, thereof. As seen in FIG. 10, the connectors 22, 27 are threadedly made up with suitable subs 52 that facilitate connection into the tool string of FIG. 1, for example.

In FIGS. 8 and 9, each of the connectors 22, 27 have a main body 28 which downwardly depends as a barrel 70 having an end 72 which abuttingly engages the ends 68 of the spring 67 such that the connectors and spring member can transfer tension and compressive loads as well as torque between the string 20 and the bit 24.

For example, a small diameter 4 ½ inch casing should suitably receive therein a 3 ¾ inch diameter flexible drill string 20 made in accordance with this invention. Such a drill string should have the heretofore unknown and unexpected advantage of forming a curve having a 12 foot radius R or less.

The present invention is of particular value in that conventional drilling equipment and methods can be used in conjunction therewith, and the need for special and costly equipment, other than that disclosed herein, is greatly reduced. The present invention can work in small diameter casing such as 4 ½ inch diameter and this also reduces the cost of forming the lateral extension of both new and old boreholes.

OPERATION OF THE INVENTION

In carrying out the Method and Apparatus of this invention, which is for curving a vertical borehole laterally towards the horizontal, a diverter is placed downhole in the borehole near the formation to be penetrated and produced. A whipstock is fixed downhole in the cased borehole at a location adjacent the formation. The special cantaloupe shaped mill is run downhole to engage the whipstock which forces the cantaloupe shaped mill against the interior of the casing to form an aperture through the casing wall in proximity of a formation to be pro- duced. Then a special concave drill is used to enlarge the opening to the desired shape and size required to admit the flexible tool string. The flexible tool string is attached to form part of the drill string, with the bit attached to the end thereof which is extended through the window where it drills a curved borehole that can be extended horizontally into the desired formation. The flexible drill string has a central fluid passage- way formed of resilient material which surrounds an inner spring member that forms a longitudinally extending bendable torque transferring drilling string. The spring member is therefore encapsulated by the elastomeric material to form the central fluid passageway. A connector affixed at each end of the spring and elastomeric material enables the tool string to be connected into a drill string, and the inner tight wrapped spring to transmit torque from the rig into the bit which forms the lateral borehole so that it is a continuation of the vertical borehole.

I claim:

1. A flexible tool string for advancing a drill bit while forming a lateral borehole which curves away from a vertical borehole and towards the horizontal, the vertical borehole having a casing extending through a production formation; said flexible tool string having a longitudinal central axis that can bend to conform to a segment of a curve; a longitudinally extending passageway formed axially through said flexible tool string; said flexible tool string being rotatably received within said casing with there being an annulus formed between the casing and tool string;

a fluid conveying conduit made of resilient material within which there is received a fully collapsible tight wrapped spiral spring member having opposed ends, and includes a central axis that defines the axis of the longitudinal central passageway; said spring member forms an inner bendable member for preventing collapse of the inner wall of the fluid conveying conduit and thereby maintaining said central fluid conveying passageway in a fluid conveying configuration; said fully collapsible spring member being in the form of a coiled spring member that bears against the inner surface of said central fluid conduit;

connector means affixed at opposed ends of the opposed ends of the spring member abuttingly engages the connector means fluid conveying conduit; whereby, rotational power imparted into one of the opposed connector means is transmitted by said coiled spring member into the other of the connector means.

2. The flexible tool string of claim 1 wherein said conduit is an elastomeric conduit and said flexible spring member is circumferentially arranged therewithin and having means by which opposed ends thereof are adjacent to the coupling members for transmitting torque while guiding a drill bit to thereby form a curved lateral borehole connected to a vertical borehole.

3. The combination of claim 1 wherein the connectors form opposed ends of said flexible drill string, said spring member having a pitch that becomes fully collapsed while transmitting torque from one to the other connector.

4. The combination of claim 3 wherein said spring member is joined to an elastomer that also forms said flexible conduit, the connector means include a barrel against which one end of the spring abuttingly engages with the elastomeric conduit being affixed to the outer surface of the barrel.

5. The combination of claim 1 wherein said flexible conduit is made of an elastomeric material together with said spring member, said spring member is closely adjacent to and circumferentially arranged about the interior of said flexible conduit; said conduit means having a barrel which telescopingly receives the conduit; the opposed ends of the spring member abuttingly engages the end of the barrel.

6. In a flexible tool string apparatus for drilling a crooked borehole, the improvement comprising:

a flexible drill string adapted to be curved to conform to a predetermined segment of a curve that interconnects a vertical length of a borehole and forms a lateral length of a borehole extending from the vertical length of a borehole;

said flexible drill string is received within a relatively inflexible well casing; said flexible drill string includes an elastomeric conduit within which there is disposed a flexible coiled spring member to form a flexible flow passageway, the flexible spring member is an elongated load transferring spiraled spring member circumferentially disposed about the interior of the elastomeric conduit and forming said flow passageway therewith; opposed connectors forming opposed ends of the flexible drill string;

the spring member having opposed ends adjacent the opposed connectors and bearing against the interior wall surface of said elastomeric conduit to thereby prevent the conduit from collapsing; said inner spring member is fully collapsible and forms a load transferring member, a second spring member about the conduit;

means, including the connectors, for connecting a drill bit to one end of said flexible drill string, and means, including the connectors, by which the other end of the flexible drill string can be attached to the end of a rigid drill string.

7. The tool string of claim 6 wherein said spring member is circumferentially arranged within the elastomeric conduit and connected thereto by the elastomer that forms the flow conduit to thereby hold the conduit and spring member together and form the flexible drill string.

8. The tool string of claim 7 wherein said spring member is joined to an elastomer that also forms said flexible conduit, the connectors each include a barrel within which one end of the spring is attached in anchored relationship, with the elastomeric conduit being affixed to the outer surface of the barrel;

said flexible flow passageway is an elastomeric conduit and a second spring member is circumferentially arranged thereabout and include means by which the spring members are connected together to capture said elastomer therebetween.

9. The apparatus of claim 6 wherein said flexible conduit has a central passageway and said spring member is circumferentially arranged therewithin and connected to the elastomer that forms said conduit to thereby hold the bendable members together and form the flexible drill string;

the spirals of said elongate spring member are placed closely adjacent to one another and spaced an equal radial distance from the longitudinal axis of the passageway; the opposed ends of said spring member, respectively, abuttingly engage the barrel of said opposed connectors, respectively.

10. Method of forming a borehole having an upper vertical length that is cased and extends into proximity of a pay zone, and thereafter curving the borehole into a lower lateral length with a small radius of curve that extends into the pay zone; comprising the steps of:

1. forming said vertical length of said borehole, and then;

2. forming an opening into the sidewall of the casing in proximity of the pay zone by anchoring a diverter downhole in the vertical length of the borehole at a location adjacent the pay zone; lowering a milling device into the vertical length of the borehole to engage the diverter and force the milling device to mill an opening into the wall of the casing;

3. elongating the opening by lowering a cutter device into the vertical length of the borehole to engage and extend the opening in the casing until a window is formed through the casing sidewall of a size to admit therethrough a flexible drill string having a drill bit connected thereto;

4. curving the lower end of said vertical length of the borehole into a lateral length that is a segment of a circle and which is a continuation of the vertical length by:

a. connecting a relatively flexible drill string to the lower end of the inflexible drill string; the flexible drill string having a central fluid conveying conduit made of resilient material within which an elongated spring member is enclosed;

b. attaching a bit to the lower terminal end of said flexible drill string;

c. transmitting rotational power from the rigid drill string into the bit by attaching coupling members at the opposed ends of the condddut and spring, and, attaching the coupling members, respectively, to the bit and rigid drill string, respectively;

d. diverting the bit from the vertical borehole to form said lateral borehole into a segment of a circle as the bit forms a borehole which extends from the vertical borehole out into the formation.

11. Method of forming a crooked borehole with a borehole forming tool string having a relatively inflexible upper length connected to be rotated by power supplied from a drilling rig, the upper length having a lower end thereof connected to rotate a flexible drill string that has a central fluid conveying conduit and opposed coupling members by which a drill bit is attached at the distal end of the lower length and the lower length is attached to the downhole end of the upper length; comprising the steps of:

A. drilling a curved borehole from the lower length of a vertical borehole and extending the curved borehole laterally away from the vertical borehole and towards the horizontal by rotating the bit as it is deflected along a path which is a segment of a circle;

B. transferring the drilling rig power to the uphole coupling member of the flexible drill string, along the flexible drill string to the downhole coupling member, and to the drill bit by connecting a fluid conveying conduit made of resilient material between the coupling members, and arranging opposed ends of a fully collapsible tight wrapped spiral spring member in abuttaing engagement to the coupling members, with the spiral of the spring being arranged to become fully collapsed and thereby transfer torque when the bit is rotated.

* * * * *